United States Patent [19]

Terada et al.

[11] 4,100,943

[45] Jul. 18, 1978

[54] SHUTTLE FOR RIBBON LOOMS

[75] Inventors: Seiko Terada, Uozu; Hissei Nishiyama, Fuchu; Masaatsu Oofusa, Kurobe, all of Japan

[73] Assignee: Yoshida Kogyo K.K., Japan

[21] Appl. No.: 751,697

[22] Filed: Dec. 17, 1976

[30] Foreign Application Priority Data

Dec. 29, 1975 [JP] Japan ..... 51/178457
Dec. 29, 1975 [JP] Japan ..... 51/178458

[51] Int. Cl.[2] ..... D03D 35/00; D03J 5/24
[52] U.S. Cl. ..... 139/201; 242/155 R
[58] Field of Search ..... 139/199, 200, 201; 242/155 R

[56] References Cited

U.S. PATENT DOCUMENTS

| | | | |
|---|---|---|---|
| 386,531 | 7/1888 | Fifield | 139/200 |
| 538,022 | 4/1895 | Lapworth | 139/199 |
| 614,802 | 11/1898 | Duplessis | 242/155 R |
| 1,019,053 | 3/1912 | Knight | 139/201 |
| 3,698,335 | 10/1972 | Forrester et al. | 242/155 R |

FOREIGN PATENT DOCUMENTS

| | | | |
|---|---|---|---|
| 549,287 | 11/1922 | France | 139/201 |
| 601,825 | 12/1925 | France | 139/201 |
| 19,604 | 6/1900 | Switzerland | 139/201 |

*Primary Examiner*—James Kee Chi
*Attorney, Agent, or Firm*—Bucknam and Archer

[57] ABSTRACT

A shuttle for ribbon looms comprises a housing and a bobbin rotatably supported in the housing for carrying a weft thread to be wound therearound. A tensioning device is provided in the housing for keeping the thread under constant tension while being unwound from the bobbin and running, the tensioning device including a frictionally rotatable roller around which the thread is wound, and means for adjusting the tension of the thread. A thread discharge eyelet is supported on the housing for discharging the thread therethrough out of the housing, the eyelet being located at the bottom of the housing and adjacent to the latter. The thread is directed from the bobbin through the tensioning device to the discharge eyelet.

2 Claims, 6 Drawing Figures

SHUTTLE FOR RIBBON LOOMS

BACKGROUND OF THE INVENTION

1. Field of the Invention

The present invention relates to a shuttle for ribbon looms.

2. Prior Art

One known expedient for keeping the thread from the shuttle bobbin under tension is a leaf spring held in frictional contact with the circumference of the bobbin which is mounted for rotation on a spindle in the shuttle housing. As the thread is unwound from the bobbin, the bobbin decreases in diameter and becomes lighter in weight, with the result that the force with which the leaf spring is pressed against the bobbin gets weaker gradually. With this type of tensioning device, therefore, the thread cannot be tensioned constantly throughout its entire length. Furthermore, the tension of the thread varies with the position at which the thread unwinds off the bobbin. The resultant woven fabrics are liable to have the irregular selvages and to become greater in width as they are being progressively produced.

Another problem with prior shuttle structures is that since the shuttle reciprocates along a substantially arcuate path through the successively formed warp shed, and the shuttle has a thread discharge eyelet in its front frame, a length of the thread after emerging from the shuttle and before being interwoven changes at all times; that is, it continues to become shorter until the shuttle enters the warp shed, and starts getting longer with the movement of the shuttle across the warp shed. Therefore, the thread is subjected to fluctuating tension upon departure from the shuttle. A pair of coil springs are disposed within the shuttle housing in order to take up the slackened thread or stabilize its tension, but are unable to follow the continuously changing tension of the thread because of high speed operation of the shuttle.

SUMMARY OF THE INVENTION

The present invention is directed to a shuttle for ribbon looms which has a roller around which the thread fed from the bobbin is wound two or three times before being discharged out through an eyelet from the shuttle. A spring is provided to normally bias the roller axiswise to be pressed against a stop plate on a fixed shaft on which the roller is rotatably supported. Frictional rotation of the roller maintains the thread under constant tension while being fed out. Means are provided for changing the biasing force of the spring. A thread discharge eyelet is located as closely to the bobbin as possible in order to minimize variations in length of the discharged thread, which variations would otherwise occur while the shuttle reciprocates in an arcuate path. According to another aspect of the invention, a first rotatable roller has a first surface and a second nonrotatable roller has a second surface, the second roller being normally biased by a spring to press the first roller against a stop plate. The first and second surfaces sandwich a thread therebetween. The thread is held in frictional contact with the second surface as the thread is drawn forcibly.

Accordingly, it is an object of the present invention to provide a shuttle for ribbon looms which is capable of keeping the unwound thread under constant tension regardless of the degree of unwinding of the thread from the bobbin, and of the position where the thread unwinds off the bobbin.

A further object of the present invention is to provide a shuttle for ribbon looms which has a thread discharge eyelet located in such a position as to reduce irregular tension of the discharged thread to a minimum.

Many other advantages, features and additional objects of the present invention will become manifest to those versed in the art upon making reference to the detailed description and the accompanying sheets of drawings in which preferred structural embodiments incorporating the principles of the present invention are shown by way of illustrative example.

ON THE DRAWINGS

AS SHOWN ON THE DRAWINGS

Figure 1:
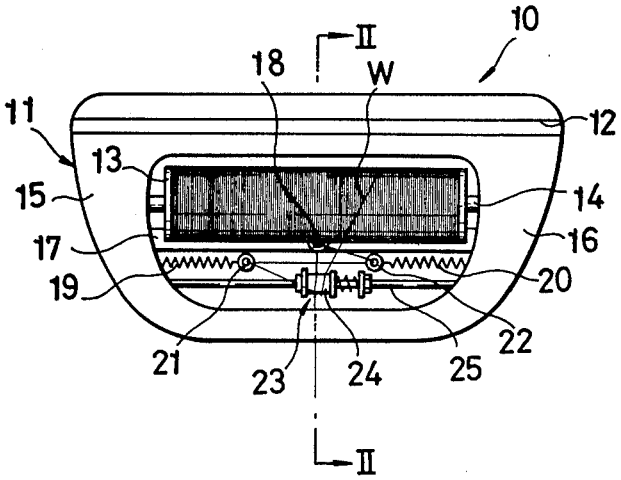
FIG. 1 is a top plan view of a shuttle constructed in accordance with the principles of the present invention.
Figure 2:
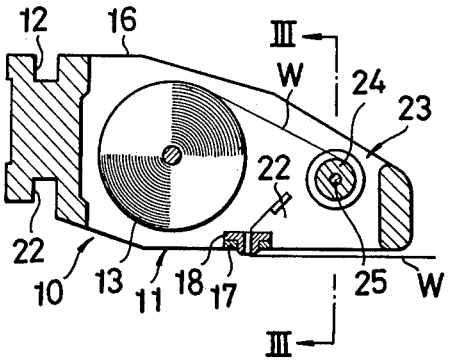
FIG. 2 is an enlarged cross-sectional view taken along line II—II of FIG. 1.

The present invention is particularly useful when embodied in a shuttle as shown in FIG. 1, generally indicated by the numeral 10. As shown in FIGS. 1 and 2, the shuttle 10 comprises a frame or housing 11 having its rear portion grooved at 12 for attachment to a shuttle guide (not shown) of a ribbon loom. A bobbin 13 with a weft thread W wound therearound is mounted for free rotation on a spindle 14 extending between a pair of side frame members 15, 16.

A support plate 17 extends in parallel with the spindle 14 between the side frame members 15, 16 and is located at the bottom of the housing 11. The support plate 17 is apertured at its substantially central portion and carries in the apertured portion a ceramic trumpet 18 that serves as a thread discharge eyelet. The support plate 17 is situated as closely to the bobbin 13 as possible provided the eyelet trumpet 18 does not interfere with rotation of the bobbin 13. A pair of extension coil springs 19, 20 are connected to the side frame members 15, 16, respectively, and have a pair of ceramic eyelets 21, 22 on their respective free ends.

Figure 3:
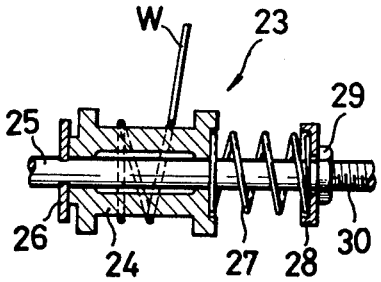
FIG. 3 is a fragmentary cross-sectional view, on an enlarged scale, taken along line III—III of FIG. 2.

A tensioning device generally designated at 23 comprises a roller 24 rotatably mounted centrally on a fixed shaft 25 extending between the side frame members 15, 16 and parallel to the spindle 14. As best shown in FIG. 3, an annular plate 26 is fixed to the shaft 25 and serves as a stop against which the roller 24 is normally urged axiswise by means of a compression coil spring 27 around the shaft 25, the spring 27 being secured to and confined by a flanged annular plate 28 loosely fitted over the shaft 25 and held in position by a nut 29 that engages an externally threaded portion 30 of the shaft 25. The force with which the end of the roller 24 is resiliently pressed against the stop plate 26 can be adjusted in strength by turning the nut 29. Thus, the roller 24 is frictionally rotatable between the stop plate 26 and the spring 27. The roller 24 is double flanged at its ends to prevent the thread W around the roller 24 from slipping out while the thread W is being fed.

The thread W unwound from the bobbin 13 is wound around the roller 24 two or three times, then threaded through the eyelets 21 and 22, and finally discharged out of the shuttle 10 through the eyelet 18. When the thread W is under tension, the roller 24, the pair of eyelets 21, 22, and the discharge eyelet 18 assume the vertexes of a rhombus as viewed in FIG. 1, or from above the shuttle 10. With this construction, since the roller 24 is subjected to frictional resistance during its rotation, the thread W drawn forcibly past the roller 24 is kept always under constant tension.

Figure 4:
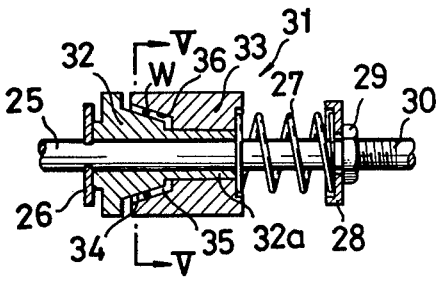
FIG. 4 is a view similar to FIG. 3 but showing a construction provided in accordance with another embodiment.
Figure 5:
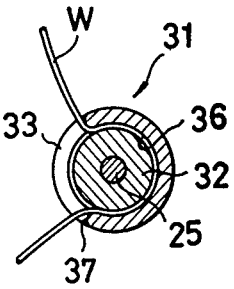
FIG. 5 is a cross-sectional view taken along line V—V of FIG. 4.

A modified tensioning device 31 shown in FIGS. 4 and 5 comprises a first roller 32 mounted for rotation on the shaft 25 and having a sleeve 32*a*, and a second roller 33 fitted over the sleeve 32*a* and secured nonrotatably to the spring 27. The first roller 32 has a peripheral surface 34 tapered toward the second roller 33, and the second roller 33 has a recess 35 shaped complementarily to and receiving the tapered surface 34 of the first roller 32. A cylindrical surface or wall 36 bounding the recess 35 is circumferentially partly cut out to provide an opening 37. The thread W enters through the opening 37, is wound around the tapered peripheral surface 34, and then is drawn out again through the opening 37. The spring 27 normally biases the second roller 33 which in turn urges the first roller 32 against the stop plate 26 with the thread W sandwiched between the cylindrical wall 36 and the tapered peripheral surface 34. The thread W is tensioned constantly by its frictional contact with the wall 36 while the thread W is drawn forcibly and drives the first roller 32 that is held in frictional contact with the stop plate 26 during the rotation. The embodiment shown in FIGS. 4 and 5 is more advantageous in that the thread W only requires less than one winding around the first roller 32, and at the same time can be retained while running in place more reliably.

Figure 6:
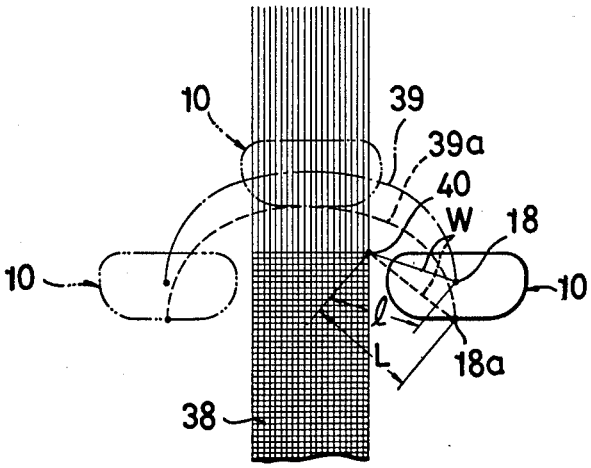
FIG. 6 is a schematic plan view illustrative of the way how the shuttle moves to weave a narrow fabric, the paths of movement of a thread discharge eyelet of the invention and a conventional one being illustrated for comparison.

As shown in FIG. 6, the shuttle 10 reciprocates across a narrow fabric 38 along a substantially arcuate path through the successively formed warp shed. The shuttle 10, in its stroke ends, is located alongside of the fell of the fabric 38 and at a level lower than the plane of the fabric 38. According to a prior art shuttle, the thread discharge eyelet 18*a* is positioned on a front end of the shuttle 10. The eyelet 18*a* follows a path 39*a* while the shuttle 10 is in motion. When the shuttle 10 is at one of the stroke ends, the discharged thread W extending between the fell end 40 and the eyelet 18*a* has a length L. On the other hand, eyelet 18 positioned according to the invention describes a path 39 during the reciprocating motion of the shuttle 10. When the shuttle 10 is at the stroke end, the discharged thread W between the fell end 40 and the eyelet 18 located rearwardly of the eyelet 18*a* has a length *l* which is shorter than the length L. Thus, with the eyelet position of the invention, a reduction in the length of the thread W between the fell end 40 and the thread discharge eyelet 18 can be held at a minimum while the shuttle 10 moves from the stroke end to a position in which it is just about to enter the warp shed. This in turn assists the pair of springs 19, 20 in taking up the slack of the thread W due to the change in its length extending between the fell end 40 and the discharge eyelet 18.

With the shuttle structure of the invention, the thread W emerging out of the shuttle 10 can be maintained under constant tension, or merely undergoes minimized tension fluctuations. This shuttle 10 is beneficial when used for weaving slide fastener tapes that require uniform, tight selvages along which rows of fastener elements are to be supported stably. Furthermore, the shuttle 10 can be employed to carry an element-forming filament in a loom of the type which produces slide fasteners with interwoven elements that must be shaped uniformly and to a nicety for the best coupling and uncoupling operation.

Although various minor modifications might be suggested by those versed in the art, it should be understood that we wish to embody within the scope of the patent warranted hereon, all such embodiments as reasonably and properly come within the scope of our contribution to the art.

What we claim is:

1. A shuttle for a ribbon loom comprising:

(a) a housing;

(b) a bobbin supported in said housing for carrying a thread to be wound therearound and for rotation about a given axis;

(c) a tensioning means in said housing for keeping the thread under constant tension while being unwound from said bobbin and running, said tensioning means including a roller for adjusting the tension of the thread and supported on said housing for rotation about an axis located forward of the rotation axis of said bobbin, said roller being disposed to receive thread unwound from the bobbin and to pay out such thread as received in a backward direction; and (d) a thread discharge eyelet supported on said housing for discharging the thread therethrough out of said housing, said thread discharge eyelet being located at a predetermined distance from the plane defined by the axes of said bobbin and roller, in a position forward of the bobbin rotation axis and backward from the roller rotation axis.

2. A shuttle according to claim 1, said tensioning means comprising a roller mounted for rotation on a shaft disposed in parallel with said bobbin in said housing, said roller being adapted to wind therearound the thread from said bobbin, a stop fixed to said shaft, and a spring normally biasing said roller against said stop, and said means being a nut threadedly engaging said shaft and holding said spring in position.

* * * * *